US008310425B2

(12) United States Patent
Okutani et al.

(10) Patent No.: US 8,310,425 B2
(45) Date of Patent: Nov. 13, 2012

(54) RESISTANCE DIVIDING CIRCUIT

(75) Inventors: Shigeki Okutani, Shiga (JP); Masaharu Takahashi, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 880 days.

(21) Appl. No.: 11/984,046

(22) Filed: Nov. 13, 2007

(65) Prior Publication Data

US 2008/0150673 A1 Jun. 26, 2008

(30) Foreign Application Priority Data

Dec. 25, 2006 (JP) ..... 2006-347959

(51) Int. Cl.
*G09G 3/36* (2006.01)

(52) U.S. Cl. ..... 345/89; 345/690

(58) Field of Classification Search ..... 345/89, 345/88, 690, 211–212, 94, 210
See application file for complete search history.

(56) References Cited

U.S. PATENT DOCUMENTS 5,534,862 A * 7/1996 Gross et al. ..... 341/144
5,956,006 A * 9/1999 Sato ..... 345/88
6,556,182 B1 * 4/2003 Goto et al. ..... 345/98
7,339,569 B2 3/2008 Moon et al.
2008/0198123 A1 8/2008 Moon et al.

FOREIGN PATENT DOCUMENTS

| | | |
|---|---|---|
| CN | 1131820 | 9/1996 |
| CN | 1409164 | 4/2003 |
| JP | 2003-152079 | 5/2003 |

OTHER PUBLICATIONS

Chinese Office Action dated May 10, 2010 with English-language translation.
Chinese Office Action dated Jan. 19, 2011, with English Translation.

* cited by examiner

*Primary Examiner* — Chanh Nguyen
*Assistant Examiner* — Roy Rabindranath
(74) *Attorney, Agent, or Firm* — McGinn IP Law Group, PLLC

(57) ABSTRACT

A resistance dividing circuit includes a resistive element formed in an area in a first line segment and a second line segment which are set on a substrate and arranged in parallel to each other; and a tap portion connected to the resistive element at a predetermined position of the first line side. A cutout in which the resistive element does not exist is formed in a place corresponding to the predetermined position in a lengthwise direction of the resistive element. In such a structure, a deviation of an actually generated divided voltage from a design value thereof can be reduced so that a highly correct gray-scale display can be achieved.

11 Claims, 8 Drawing Sheets

RESISTANCE DIVIDING CIRCUIT

CROSS REFERENCE

This application is related to Japanese Laid-Open Patent (JP-P2006-347959A). The disclosure of that application is incorporated herein by reference.

BACKGROUND OF THE INVENTION

1. Field of the Invention

The present invention relates to a resistance dividing circuit for generating gray-scale voltages.

2. Description of Related Art

There are widely used display devices, such as a TFT (Thin Film Transistor) liquid crystal display device, a simple matrix type liquid crystal display device, an electroluminescence (EL) display device, a plasma display device, and the like.

In such a display device, for controlling the gray-scale level of a pixel, a gray-scale voltage generating circuit is used which generates a gray-scale voltage to be applied to the pixel. FIG. 1 shows a portion of such a circuit. On a substrate, a resistive element 155 is provided which extends in a predetermined extending direction. Between a first end (not shown) and a second end (not shown) of the resistive element 155, a reference voltage is applied. At a plurality of tap connection sections 160 set to place between the first and second ends of the resistive element 155, projecting sections 153-2 are respectively formed with electric conducting material. At each projecting section 153-2, a contact 153-1 is formed. The projecting section 153-2 and the contact 153-1 form a tap 153. A voltage between the plurality of taps 153 is extracted from the potentials supplied by the plurality of contacts 153-1 for generating a gray-scale voltage.

In Japanese Laid-Open Patent Application (JP-P2003-152079A), a method for designing a reference voltage generation system is described. In this method, in the middle of a resistive element which is electrically uniform across the entire lengthwise region across which a constant voltage is fed, voltage extraction sections generating voltages of mutually different values are arranged based on correlation between resistance values of these voltage extraction sections in accordance with values of voltage to be generated. This designing method is characterized in that: a bending portion whose resistance value is previously measured is formed between the aforementioned voltage extraction sections in the resistive element in accordance with an area of a region on a semiconductor integrated circuit where the resistive element needs to be arranged; a correlation coefficient for converting a length of a current path at the bending portion calculated by using an actually measured resistance value of the bending portion into a length of the linear portion of this current path is calculated; and a value of resistance between the voltage extraction sections including the bending portion is obtained by using this correction coefficient. This consequently permits achieving space saving with a simple configuration and also providing a reference voltage with high accuracy for each gray-scale.

SUMMARY

The present inventors have recognized that the gray-scale voltage generation through the circuit as shown in FIG. 1 has the following problem. In a gray-scale voltage generating circuit with a partial configuration as shown in FIG. 1, the width and the thickness in a direction perpendicular to the lengthwise direction of the resistive element 155 are constant.

To this resistive element 155, the taps 153 are connected. Consequently, at a tap connection section 160 to which this tap 153 is connected, a current path 157 for a current flowing substantially in the lengthwise direction of the resistive element 155 widens in the direction perpendicular to this lengthwise direction due to the existence of the projecting sections 153-2. As a result, the area of a cross section perpendicular to the lengthwise direction of the resistive element 155 at the tap connection section 160 becomes effectively large. Thus, compared to a resistance value (design value) theoretically expected based on a distance between taps 153, the effective resistance value is small. Furthermore, a resistance ratio between taps 153 deviates from a theoretical value thereof used for designing. The deviation of the resistance value from the theoretical value makes it difficult to achieve an excellent gray-scale reproducibility required for achieving higher resolution multi-gray-scale.

The present invention seeks to solve one or more of the above problems, or to improve upon those problems at least in part.

In one embodiment of the present invention, a resistance dividing circuit includes: a resistive element formed in an area in a first line segment and a second line segment which are set on a substrate and arranged in parallel to each other; and a tap portion connected to the resistive element at a predetermined position of the first line segment side. A cutout in which the resistive element does not exist is formed in a place corresponding to the predetermined position in a lengthwise direction of the resistive element.

In another embodiment of the present invention, a resistance dividing circuit includes: a resistive element; and a tap portion connected to a predetermined position of the resistive element and a divided voltage generated by dividing a reference voltage applied to the resistive element is taken therefrom. The resistive element around the predetermined position is formed from resistive material filling an area defined by removing a cutout by which a cross section of the resistive element orthogonal to a lengthwise direction of the resistive element is reduced from an area between two line segments parallel to the lengthwise direction of the resistive element.

According to the present invention, the difference between an effective resistance value and a designed resistance value for a resistance dividing circuit can be suppressed. As a result, a gray-scale voltage very close to a design value can be generated.

BRIEF DESCRIPTION OF THE DRAWINGS

The above and other objects, advantages and features of the present invention will be more apparent from the following description taken in conjunction with the accompanying drawings, in which.

DETAILED DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Figure 1:
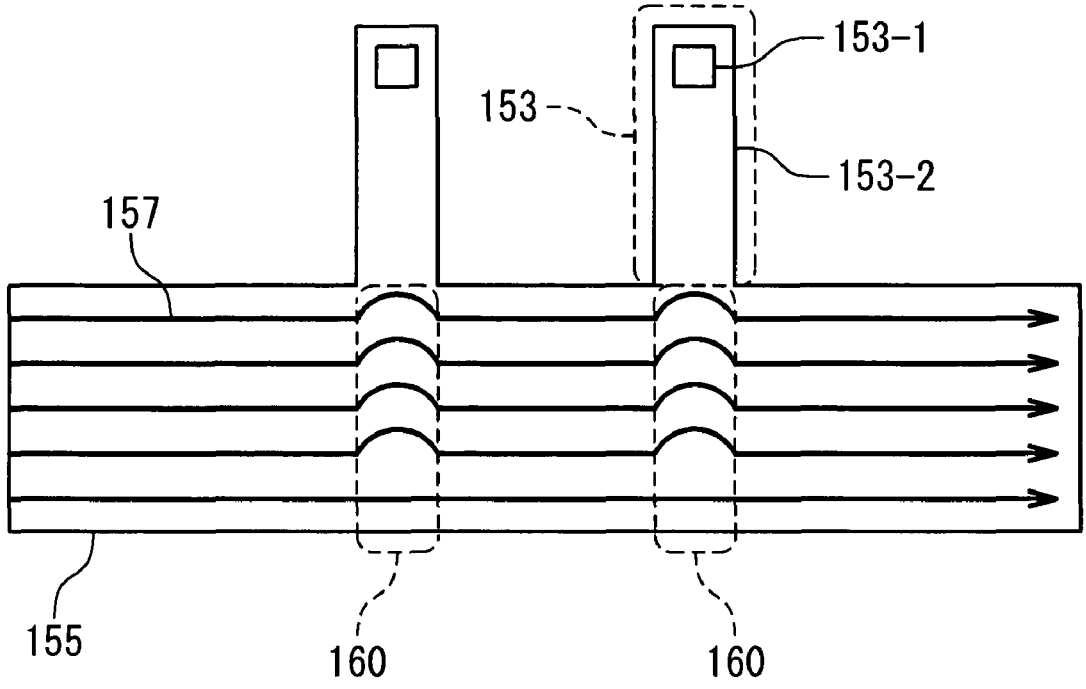
FIG. 1 is an enlarged plan view of tap connection sections of a resistive element in a related technique.
Figure 2:
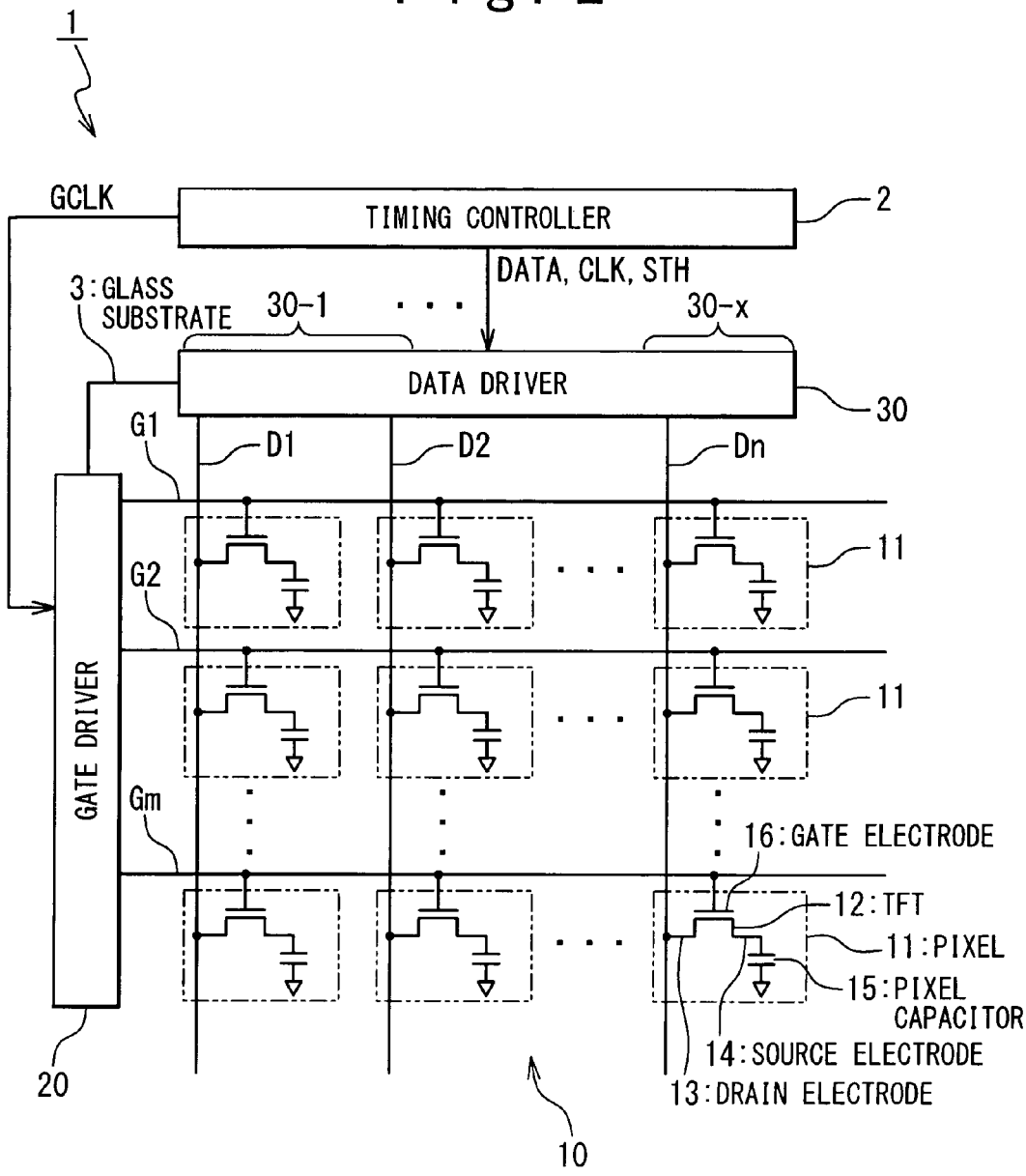
FIG. 2 shows a configuration of a TFT type liquid crystal display according to an embodiment of the present invention.

FIG. 2 shows a configuration of a TFT type liquid crystal display. The TFT type liquid crystal display 1 is provided with a glass substrate 3 and a display section (liquid crystal panel) 10. The liquid crystal panel 10 is provided with a plurality of pixels 11 arranged in a matrix form on the glass substrate 3. For example, as the plurality of pixels 11, a (m×n) number of pixels 11 are arranged on the glass substrate 3 (where m and n are each an integer of 2 or more). Each of the (m×n) number of pixels 11 is provided with a thin film transistor (TFT) 12 and a pixel capacitor 15. The pixel capacitor 15 is provided with a pixel electrode and an opposite electrode opposing the pixel electrode. The TFT 12 is provided with a drain electrode 13, a source electrode 14 connected to the pixel electrode, and a gate electrode 16.

The TFT type liquid crystal display 1 is further provided with a gate driver 20, a data driver 30 as a driving driver, an m-number of gate lines G1 to Gm placed at first to m-th positions, and an n-number of data lines D1 to Dn placed at first to n-th positions. The gate driver 20 is formed on a chip (not shown) and connected to one end of a group of the m-number of gate lines G1 to Gm. The data driver 30 is formed on the chip and connected to one end of a group of the n-number of data lines D1 to Dn. The m-number of gate lines G1 to Gm are respectively connected to the gate electrodes 16 of the TFTs 12 of the pixels 11 provided in m rows. The n-number of data lines D1 to Dn are respectively connected to the drain electrodes 13 of the TFTs 12 of the pixels 11 provided in n columns.

The TFT type liquid crystal display 1 is further provided with a timing controller 2. The timing controller 2, for example, supplies a gate clock signal GCLK to the gate driver 20 for selecting the gate line G1 in one horizontal period. The gate driver 20, in response to the gate clock signal GCLK, outputs a selection signal to the gate line G1. At this point in time, to the gate line G1, the selection signal is transmitted from one end to the other end thereof in this order, and the TFTs 12 of the (1×n)-number of pixels 11 corresponding to the gate line G1 are turned on by the selection signal supplied to the gate electrodes 16.

The timing controller 2 supplies a clock signal CLK and one-line display data DATA to the data driver 30. The one-line display data DATA includes an n-number of pieces of display data respectively corresponding to the data lines D1 to Dn.

The data driver 30, in accordance with the clock signal CLK, outputs the n-number of pieces of display data to the n-number of data lines D1 to Dn, respectively. At this point in time, the TFTs 12 of the (1×n)-number of pixels 11 corresponding to the gate line G1 and the n-number of data lines D1 to Dn are turned on. Thus, the n-number of pieces of display data are respectively written to the pixel capacitors 15 of the (1×n)-number of pixels 11 and held until next writing operation. Consequently, the n-number of pieces of display data are displayed as the one-line display data DATA.

Figure 3:
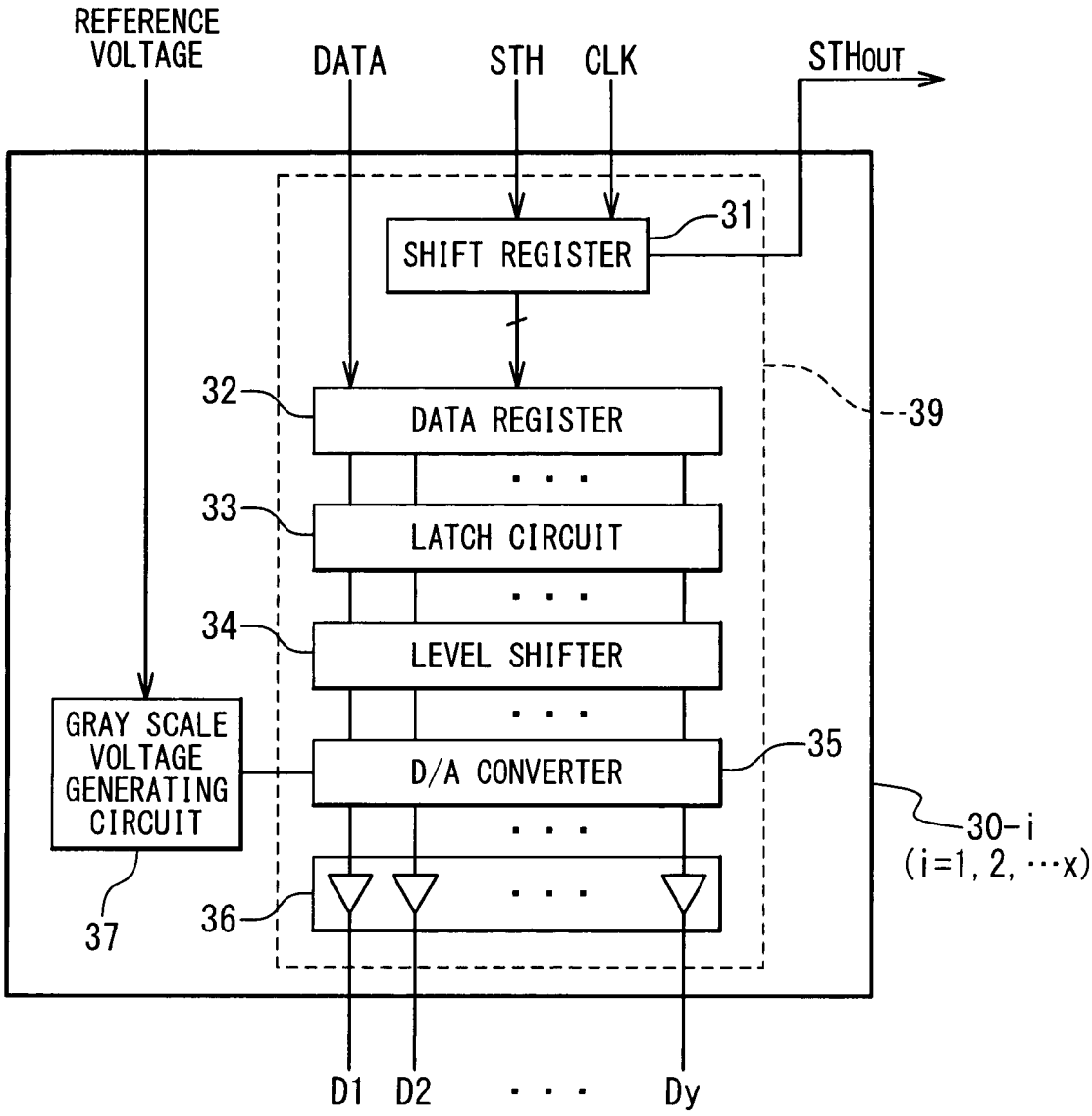
FIG. 3 shows a configuration of a data driver of the TFT type liquid crystal display.

FIG. 3 shows a configuration of the data driver 30. The data driver 30 includes an x-number sections of data drivers 30-1 to **30-*x*** placed at the first to x-th positions and connected together in cascade arrangement in this order for the purpose of sharing display of an n-number of pixels. Here, x=n/y holds where x is an integer and y is an integer of 2 or more.

Each of the x-number of data drivers 30-1 to 30-n is provided with a shift register 31, a data register 32, a latch circuit 33, a level shifter 34, a digital/analog (D/A) converter 35, a data output circuit 36, and a gray-scale voltage generating circuit 37. The shift register 31 is connected to the data register 32, which is connected to the latch circuit 33. The latch circuit 33 is connected to the level shifter 34, which is connected to the D/A converter 35. The D/A converter 35 is connected to the data output circuit 36 and the gray-scale voltage generating circuit 37. A y-number of output buffers of the data output circuit 36 are respectively connected to one end of each of the y-number of data lines D1 to Dy.

Figure 4:
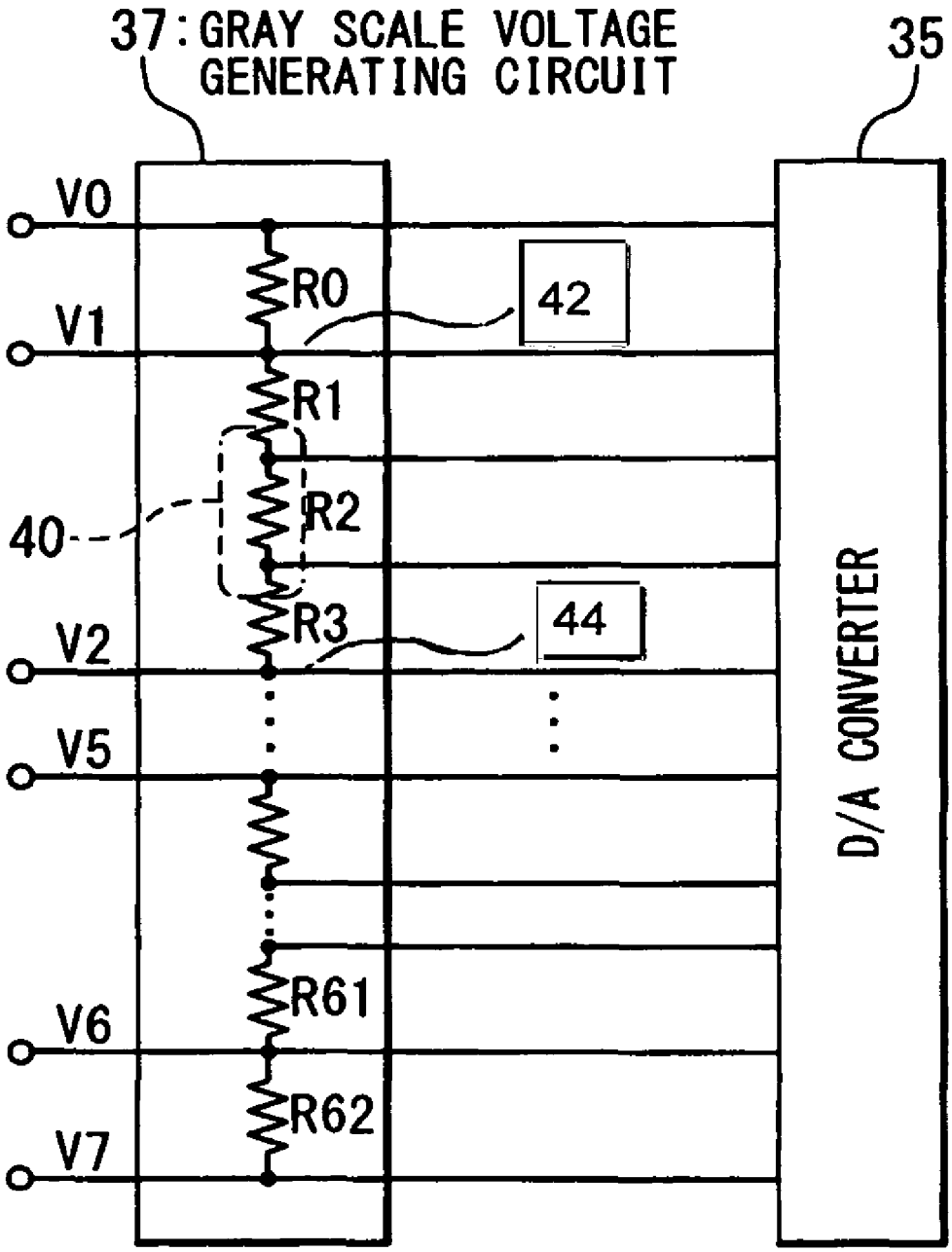
FIG. 4 shows a configuration of a gray-scale voltage generating circuit.

The gray-scale voltage generating circuit 37 is provided with a plurality of γ-correcting resistive elements serially connected together. This gray-scale voltage generating circuit 37 divides a reference voltage supplied from a power supply circuit (not shown) by the plurality of γ-correcting resistive elements to generate a plurality of gray-scale voltages. For example, for the TFT type liquid crystal display 1 performing gray-scale display of 64 levels, as shown in FIG. 4, the gray-scale voltage generating circuit 37 divides reference voltages V0 to V7 by 63 γ-correcting resistive elements R0 to R62 to generate 64 gray-scale positive gray-scale voltages as the plurality of gray-scale voltages. The negative gray-scale voltages are generated by a similar manner.

The shift register 31 is provided with a y-number of shift registers (not shown). The data register 32 is provided with a y-number of data registers (not shown). The latch circuit 33 is provided with a y-number of latch circuits (not shown). The level shifter 34 is provided with a y-number of level shifters (not shown).

Figure 5:
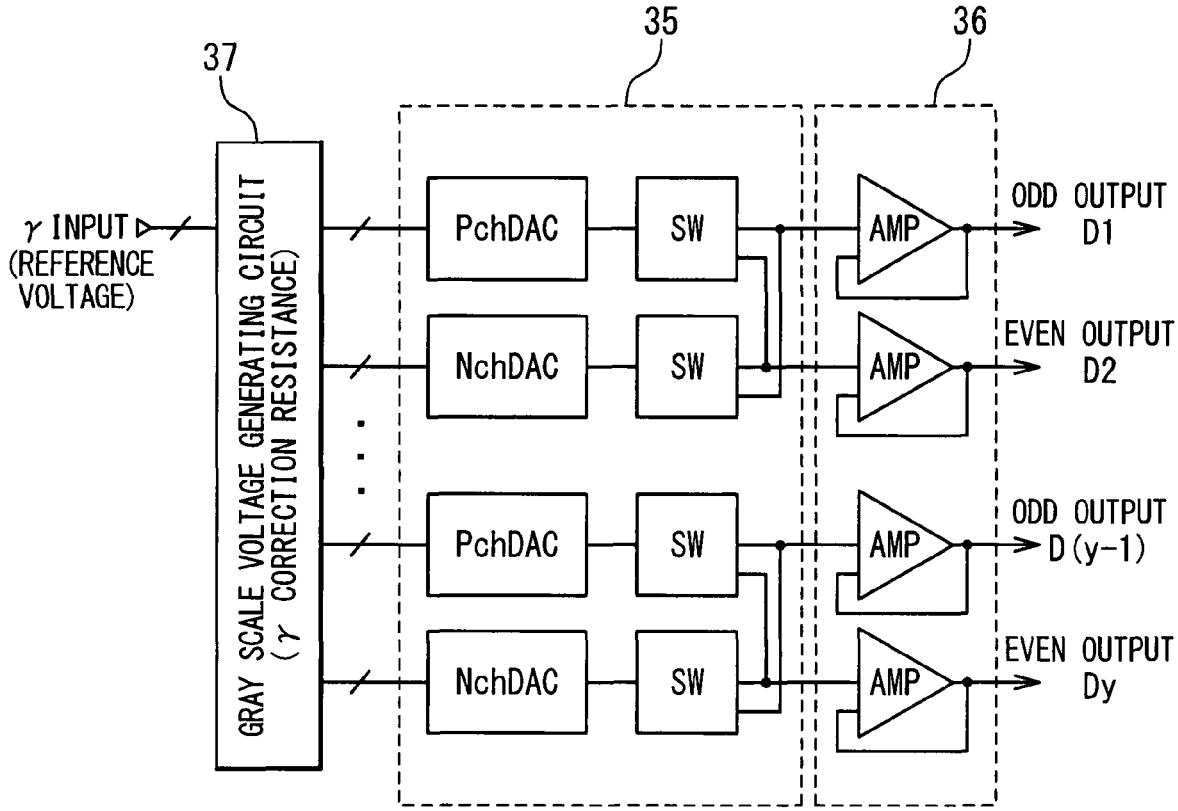
FIG. 5 shows a configuration of a D/A converter and a data output circuit.

The D/A converter 35 is provided with a y-number of D/A converters (see FIG. 5). The y-number of D/A converters described above include P-channel converters (PchDACs) each of which outputs a positive gray-scale voltage as an output gray-scale voltage and a N-channel converters (NchDACs) each of which outputs a negative gray-scale voltage as an output gray-scale voltage. For example, of the y-number of D/A converters described above, odd-numbered D/A converters are provided as PchDACs and even-numbered D/A converters are provided as NchDACs. The D/A converter 35 is further provided with a y-number of switching elements (see FIG. 5) for performing an inversion driving of alternately applying a positive gray-scale voltage and a negative gray-scale voltage to the pixels 11. The data output circuit 36 is provided with a y-number of output buffers (see FIG. 5).

Next, an operation of the TFT type liquid crystal display 1 with such configuration will be described.

The timing controller 2 supplies the clock signal CLK and the one-line display data DATA to the x-number of data drivers 30-1 to **30-*x* and supplies a shift pulse signal STH to the data driver 30-*i*. The data driver 30-*i*, in response to the clock signal CLK and the shift pulse signal STH, outputs y-number of pieces of display data included in the one-line display data DATA to the y-number of data lines D1** to Dy, respectively. Here, i is an integer that satisfies $1 \leqq i \leqq x$.

In this case, in the data driver **30-*i* (i=1, 2, . . . , x−1), each of the y-number of shift registers of the shift register 31 sequentially shifts the shift pulse signal STH in synchronization with the clock signal CLK and then outputs it to the y-number of data registers of the data register 32. The y-th shift register of the shift register 31 outputs (cascade output) a shift pulse $STH_{OUT}$ to the data driver 30**-(*i*+1) (i=1, 2, . . . , x−1) and also outputs it to the y-th data register of the data register 32. In the data driver 30-*x*, each of the y-number of shift registers of the shift register 31 sequentially shifts the shift pulse signal STH in synchronization with the clock signal CLK, and then outputs it to the y-number of data registers of the data register 32.

In the data driver 30-*i*, the y-number of data registers of the data register 32 respectively take in the y-number of pieces of display data from the timing controller 2 in synchronization with the shift pulse signal STH supplied from the y-number of shift registers of the shift register 31, and then respectively output them to the y-number of latch circuits of the latch circuit 33. These y-number of latch circuits respectively latch the y-number of pieces of display data from the y-number of data registers of the data register 32 at the same timing, and then respectively output them to the y-number of level shifters of the level shifter 34. These y-number of level shifters respectively perform a level conversion on the y-number of pieces of display data, and then respectively output them to the y-number of D/A converters of the D/A converter 35. These y-number of D/A converters perform a digital-analog conversion on the y-number of pieces of display data from the y-number of level shifters of the level shifter 34.

For example, as shown in FIG. 5, the PchDACs as the odd-numbered (first, third, . . . , and (y−1)-th) D/A converters respectively select, from among 64 positive gray-scale voltages, output gray-scale voltages in accordance with the display data from the odd-numbered (first, third, . . . , and (y−1)-th) level shifters, and then respectively output them to the odd-numbered (first, third, . . . , and (y−1)-th) output buffers of the data output circuit 36 via the odd-numbered (first, third, . . . , and (y−1)-th) switching elements. In this case, the NchDACs as the even-numbered (second, fourth, . . . , y-th) D/A converters respectively select, from among 64 negative gray-scale voltages, output gray-scale voltages in accordance with the display data from the even-numbered (second, fourth, . . . , y-th) level shifters, and then respectively output them to the even-numbered (second, fourth, . . . , y-th) output buffers of the data output circuit 36 via the even-numbered (second, fourth, . . . , y-th) switching elements.

On the other hand, in performing an inversion driving, as shown in FIG. 5, the PchDACs as the odd-numbered (first, third, . . . , and (y−1)-th) D/A converters respectively select, from among 64 positive gray-scale voltages, output gray-scale voltages in accordance with the display data from the odd-numbered (first, third, . . . , and (y−1)-th) level shifters, and then respectively output them to the even-numbered (second, fourth, . . . , y-th) output buffers of the data output circuit 36 via the odd-numbered (first, third, . . . , and (y−1)-th) switching elements. In this case, the NchDACs as the even-numbered (second, fourth, . . . , y-th) D/A converters respectively select, from among 64 negative gray-scale voltages, output gray-scale voltages in accordance with the display data from the even-numbered (second, fourth, . . . , y-th) level registers, and then respectively output them to the odd-numbered (first, third, . . . , (y−1)-th) output buffers of the data output circuit 36 via the even-numbered (second, fourth, . . . , y-th) switching elements.

Consequently, the y-number of D/A converters described above respectively output y-number of output gray-scale voltages to the y-number of output buffers of the data output circuit 36. These y-number of output buffers respectively output the y-number of pieces of display data from the D/A converters 35 to the y-number of data lines D1 to Dy.

Figure 6:
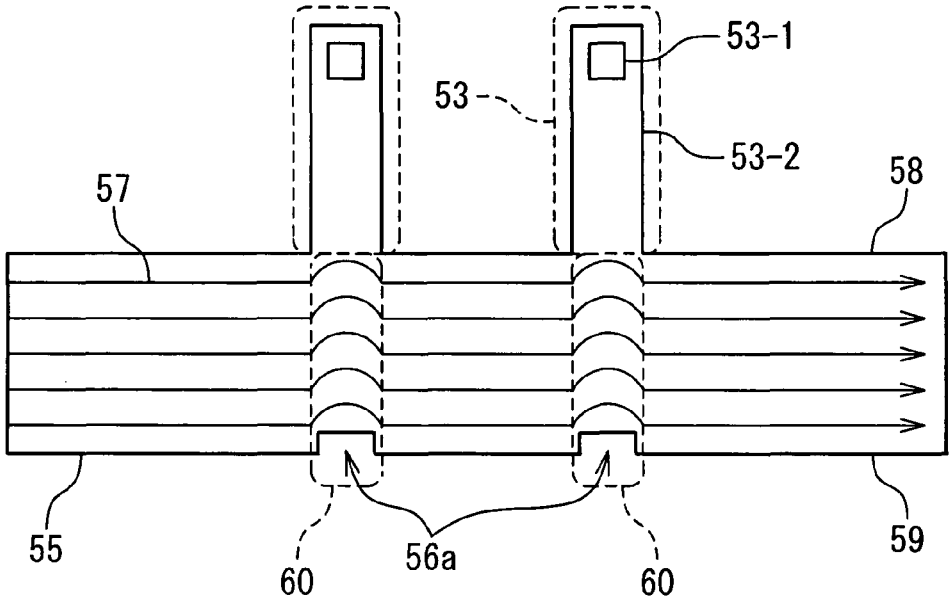
FIG. 6 is an enlarged plan view of tap connection sections of a resistive element.

FIG. 6 is an enlarged view of a partial region 40 of the γ-correcting resistive elements R0 to R62 of FIG. 4. The γ-correcting resistive elements R0 to R62 (R1 to R3 in the region shown in FIG. 4 between node 42 at voltage V1 and node 40 at voltage V2) are realized by using a resistive element 55, which is so provided as to extend in a predetermined extending direction on the substrate, separately for different regions divided in an extending direction.

In designing, the positions of tap connection sections are set at predetermined positions in the extending direction of the resistive element 55. A width (that is, a length in a direction perpendicular to the extending direction) of the resistive element 55 is, when notches 56 to be described later are neglected, substantially constant at least near the tap connection sections 60. The resistive element 55 is formed by electric conductors that fill, near the tap connection sections 60, regions, excluding the notch 56 regions to be described later, between a first side edge 58 along a first line segment set on a substrate and a second side edge 59 along a second line segment arranged adjacently and in parallel to this first line segment.

In contact with the first side edge 58 of each of the tap connection sections 60, a projecting section 53-2 is formed. At the projecting section 53-2, a contact 53-1 is formed. The projecting section 53-2 and the contact 53-1 form a tap 53. From a plurality of taps 53, the potentials of the resistive element 55 at the tap connection sections 60 are extracted via the respective contacts 53-1, and a gray-scale voltage as a potential difference between them is supplied to the D/A converter 35.

At each of the tap connection sections 60, a cutout region is formed which reduces a sectional area of the resistive element 55. Inside the cutout region, electric conductive material forming the resistive element 55 does not exist. In the example of FIG. 6, the cutout is a notch 56*a* formed on a side opposite to the tap 53, that is, the second side edge 59 side. The notch 56*a* is provided inside a region defined by the first side edge 58 and the second side edge 59. Near the tap connection section 60, of the region defined by the first side edge 58 and the second side edge 59, the region excluding the notch 56*a* is filled with electric conductive material functioning as the resistive element 55, while electric conductive material functioning as the resistive element 55 does not exist in the notch 56*a* region.

The notch 56*a* has an open end on a second side edge 59 side, i.e., a side opposite to the tap 53. The notch 56*a* arranged in this position can be formed easily. The notch 56*a* has a shape of a rectangle. A first side of this rectangle corresponds to the open end on the second side edge 59. A second side opposing the first side is a bottom side of the notch and parallel to the extending direction of the resistive element 55. A third side adjacent to both of the first and second sides is perpendicular to the extending direction of the resistive element 55. A fourth side opposing the third side is also perpendicular to the extending direction of the resistive element 55.

The projecting section 53-2 of the tap 53 connects with the resistive element 55 in a region between a first position and a second position determined in the extending direction of the resistive element 55. The third and fourth sides of the notch 56*a* are respectively arranged at positions substantially corresponding to the first and second positions, that is, positions at which lines drawn respectively from the first and second positions to a direction perpendicular to the extending direction of the resistive element 55 intersect with the second side edge 59. More preferably, the third and fourth sides are respectively arranged inside regions defined by the first and second positions by respective predetermined lengths. Such a notch 56*a* is formed at part or all of areas where the taps 53 are connected to the γ-correcting resistive elements R0 to R62.

At the tap connection section 60, due to the existence of the projecting section 53-2, an effective sectional area of the resistive element 55 is larger than sectional areas of the other regions if the notches do not exist. Due to an existence of the notches 56*a* in the present embodiment, compared to a case where no notch 56*a* is formed, the effective sectional area of the resistive element 55 at the tap connection section 60 is smaller. Therefore, forming the notch 56*a* in appropriate size and shape at an appropriate position permits bringing the effective sectional areas of the resistive element 55 at the tap connection section 60 and at the other portions to be nearly equal to each other. That is, the effective width of the current path 57 at a portion where the tap 53 is formed is so adjusted as to become nearer to the width of the current path 57 at a portion where no tap 53 is formed, thereby correcting resistance reduction due to widening of the current path 57 stemmed from the tap 53. As a result, a deviation between an actual resistance ratio among the taps 53 and a theoretical resistance ratio calculated based on distance between the taps 53 is corrected, thus permitting extraction of a gray-scale voltage closer to a theoretical value.

For example, when a tap 53 of 1 μm in width is provided perpendicularly to an interconnection (the resistive element 55) of 3 μm in width, by providing a square notch of 1 μm in the extending direction of the interconnection and 0.1 μm in a tap direction (a direction orthogonal to the extending direction), a correction can be made so that a resistance value per unit length becomes equal to that at a portion where no tap 53 is provided.

The data driver 30 inputs display data, and, in response to the input data, selects an output gray-scale voltage from among a plurality of gray-scale voltages generated by the gray-scale voltage generating circuit 37. The pixel 11 of the liquid crystal panel 10 performs display based on the gray-scale level specified by this output gray-scale voltage. Such display is performed by using the gray-scale voltage extremely close to a design value so that the displayed gray-scale level is very near to an ideal level.

Figure 7:
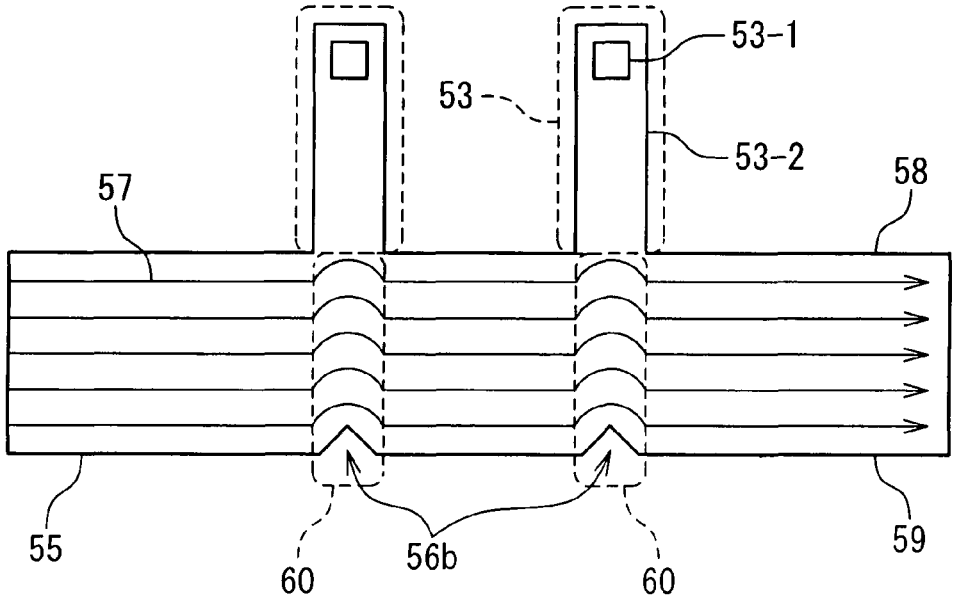
FIG. 7 is an enlarged plan view of tap connection sections of the resistive element.

FIG. 7 shows another example of notches formed at the tap connection sections 60. Instead of the notch 56*a* in FIG. 6, a notch 56*b* of an isosceles-triangular shape is formed on the side opposite to the tap 53 of the tap connection section 60. The base of the isosceles triangle corresponds to an open end on the second side edge 59. The vertex of the triangle is arranged at a position corresponding to a widthwise center side of the tap 53. The notch 56*b* of such a shape also permits achieving the same effect as is achieved by the rectangular notch 56*a*.

Figure 8:
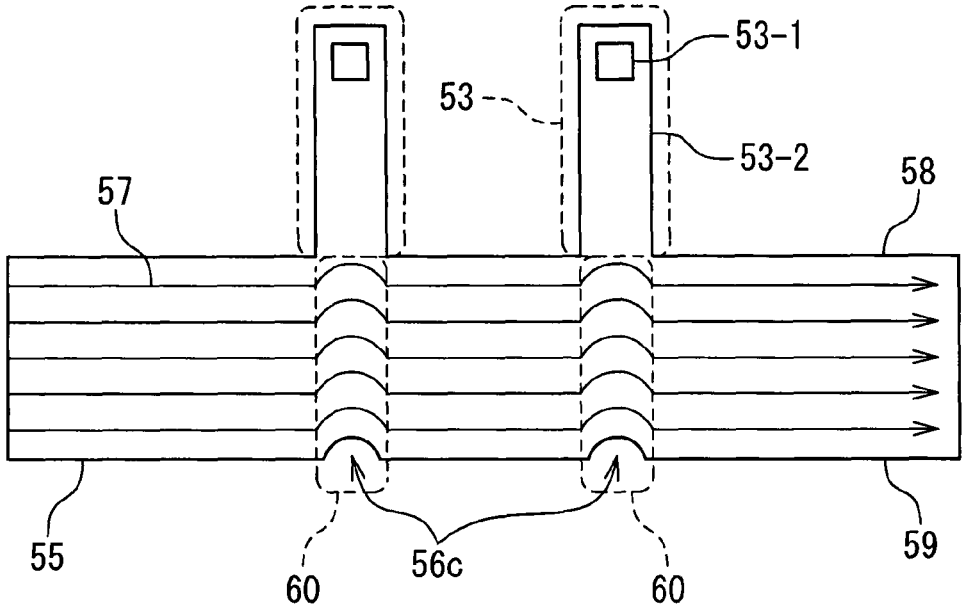
FIG. 8 is an enlarged plan view of tap connection sections of the resistive element.

FIG. 8 shows still another example of the notches. Instead of the notch 56*a* in FIG. 6, a round notch 56*c* is formed on a side opposite to the tap 53 of the tap connection section 60. The notch 56*c* has an arched contour drawn by a circular arc formed by a boundary of the electric conductor forming the resistive element 55 and by a string of this circular arc corresponding to an open end on a second side edge of the notch 56*c*. The center of this circle is arranged at a position corresponding to the widthwise center side of the tap 53. The notch 56*c* of such a shape also permits achieving the same effect as is achieved by the rectangular notch 56*a*.

Figure 9:
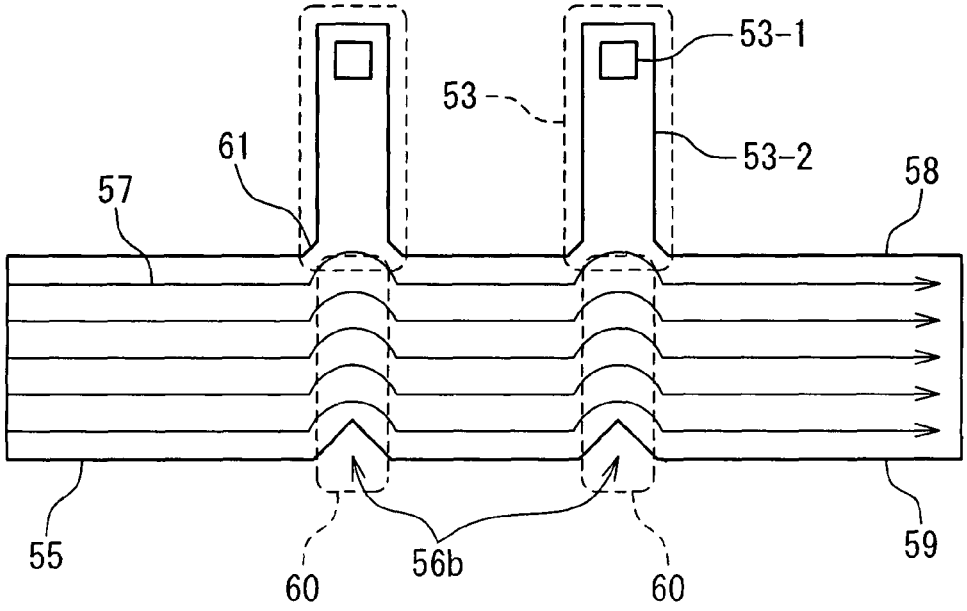
FIG. 9 is an enlarged plan view of tap connection sections of the resistive element.

FIG. 9 shows a configuration in which tapered sections 61 are formed of the projection sections 53-2. In the resistive element 55 shown in FIG. 9, the same triangular notches 56*b* as those of the resistive element 55 shown in FIG. 7 are formed. The tap 53 has a tapered section 61 near a base section of the projecting section 53-2 where the tap 53 is connected to the first side edge 58 of the resistive element 55. At the tapered section 61, the width of the projecting section 53-2 (a length of the resistive element 55 of the tap 53 in a direction parallel to the extending direction in the example of FIG. 9 is smaller at a portion more distant from the base section.

By forming the tapered section 61, it is possible to increase the sectional area of the resistive element 55 at the tap connection section 60 to decrease the specific resistance value. Parallel use of the notch 56 and the tapered section 61 makes it easy to design an actual resistance value to be closer to a desired value. Such a tapered section 61 can be used in parallel with a notch of various shape as shown in FIGS. 6 to 8.

Figure 10:
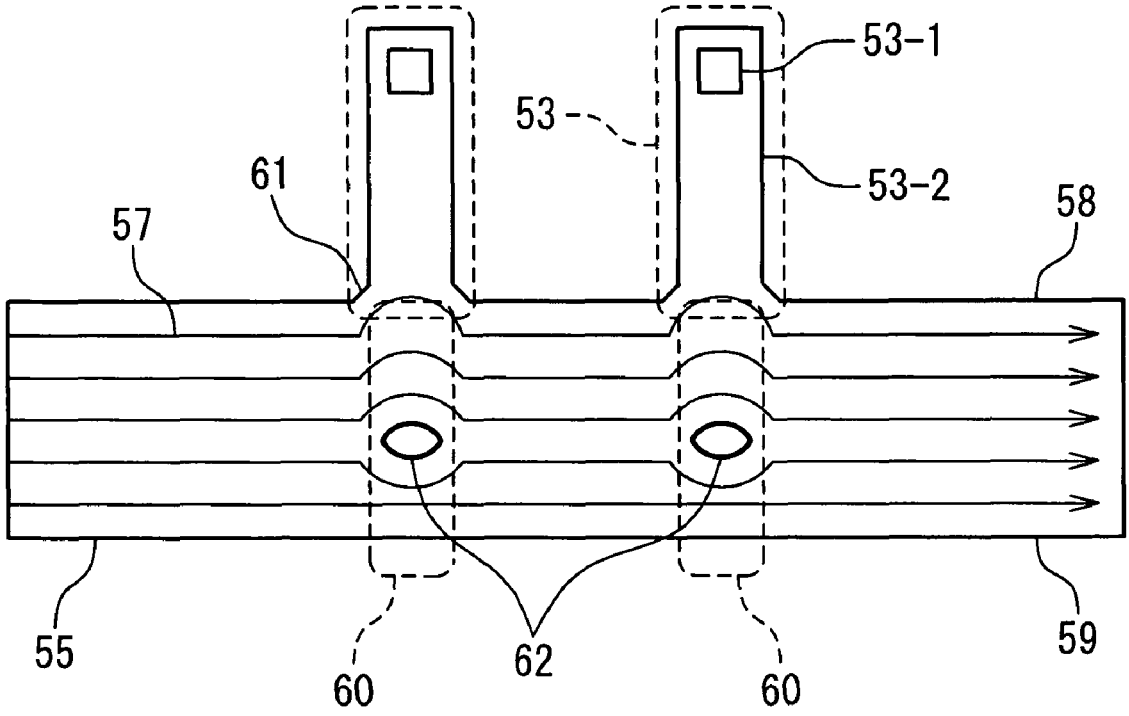
FIG. 10 is an enlarged plan view of tap connection sections of the resistive element.

FIG. 10 shows a configuration of cutouts formed instead of the notches shown in FIGS. 6 to 9. At the tap connection sections 60 of the resistive element 55, cutouts 62 are formed. The cutout 62 has a contour surrounded by electric conductive material forming the resistive element 55. Inside the cutout 62, electric conductive material functions as the resistive element 55 does not exist. Even with such the cutout 62, the sectional area of the resistive element 55 at the tap connection section 60 is reduced, providing the same effect as is provided by the notches 56*a* to 56*c*. Such a cutout 62 can be used in combination with the tapered section 61 at the base section of the projecting section 53-2 as shown in FIG. 9.

A notch or a cutout is designed to provide a constant current density on a cross-section orthogonal to the direction of electric current flowing in the resistive element 55. As long as design satisfying such a condition is achieved, the shape and size of the notch or the cutout are not limited to those described as the embodiments, and thus they may be in a different shape and a different size. By using device simulator or the like, such a design can be achieved.

It is apparent that the present invention is not limited to the above embodiments, but may be modified and changed without departing from the scope and spirit of the invention.

What is claimed is:

1. A resistance dividing circuit comprising:

a resistive element formed in an area between a first line segment and a second line segment which are set on a substrate and arranged in parallel to each other, thereby the resistive element is sheet-shaped along the first and second line segments; and a tap portion connected to and attached on a side wall of the sheet-shaped resistive element and located at a predetermined position at the first line segment side, wherein a cutout, being an area in which the resistive element does not exist, is formed in a place corresponding to the predetermined position in a lengthwise direction of the resistive element, wherein the resistive element has substantially a fixed width, which is equivalent to an interval between the first and second line segments, everywhere except at the predetermined position where a width of the resistive element is effectively more narrow than elsewhere, wherein a part of the cutout and a part of the resistive element are arranged in a lateral position, and wherein the tap portion has a taper having a width that becomes wider towards the resistive element in a lengthwise direction.

2. The resistance dividing circuit according to claim 1, wherein terminals on which a reference voltage is applied is formed at a first node and a second node of the resistive element, and the predetermined position is placed between the first node and the second node.

3. The resistance dividing circuit according to claim 1, wherein the cutout is formed adjacent to the predetermined position in the lengthwise direction of the resistive element.

4. The resistance dividing circuit according to claim 1, wherein the cutout is formed, at the predetermined position, in the resistive element.

5. The resistance dividing circuit according to claim 1, wherein the cutout is formed in a position corresponding to the predetermined position of the tap portion.

6. The resistance dividing circuit according to claim 1, wherein the cutout is formed in a position and area to compensate at least in part a resistance value formed around the tap portion on the resistive element.

7. The resistance dividing circuit according to claim 1, wherein the part of the cutout and the part of the resistive element are arranged in the lateral position in reference to the tap portion, and wherein the cutout is set to a size to reduce the resistance value of the resistive element to a predetermined value.

8. The resistance dividing circuit according to claim 7, wherein the cutout and the resistive element are both arranged in along a linear line of the lateral position, while the tap portion is in a vertical position in reference to the resistive element and the cutout.

9. A driver comprising:

a resistance dividing circuit; and a controller, wherein the resistance dividing circuit includes:

a resistive element formed in an area between a first line segment and a second line segment which are set on a substrate and arranged in parallel to each other, thereby the resistive element is sheet-shaped along the first and second line segments, and a tap portion connected to and attached on a side wall of the resistive element at a predetermined position of the first line side, wherein a cutout, being an area in which the resistive element does not exist, is formed in a place corresponding to the predetermined position in a lengthwise direction of the resistive element, wherein terminals on which a reference voltage is applied are formed at a first node and a second node of the resistive element, and the predetermined position is placed between the first node and the second node, wherein a control unit configured to control a gray-scale of a pixel of a display based on a gray-scale voltage is generated by dividing the reference voltage using potentials taken from the tap portion in response to a data inputted for displaying, wherein the resistive element has substantially a fixed width, which is equivalent to an interval between the first and second line segments, everywhere except at the predetermined position where a width of the resistive element is effectively more narrow than elsewhere, wherein a part of the cutout and a part of the resistive element are arranged in a lateral position, and wherein the tap portion has a taper having a width that becomes wider towards the resistive element in a lengthwise direction.

10. The driver according to claim 9,wherein a cutout is formed in a position and area adjacent to and in electrical communication with the tap portion.

11. The driver according to claim 9,wherein a cutout is formed in a position and area proximate with the tap portion in a shape and size according to the surface area of the resistive element around the predetermined area of the tap portion.

* * * * *